United States Patent [19]

Scherbatskoy

[11] 4,057,781

[45] Nov. 8, 1977

[54] WELL BORE COMMUNICATION METHOD

[76] Inventor: Serge A. Scherbatskoy, 3517 Westridge, Fort Worth, Tex. 76116

[21] Appl. No.: 668,646

[22] Filed: Mar. 19, 1976

[51] Int. Cl.[2] ..... G01V 1/40

[52] U.S. Cl. ..... 340/18 LD; 340/18 R

[58] Field of Search ..... 340/18 LD, 18 NC, 18 R

[56] References Cited

U.S. PATENT DOCUMENTS

| | | | |
|---|---|---|---|
| 3,186,222 | 6/1965 | Martin | 340/18 LD |
| 3,315,224 | 4/1967 | Ferguson | 340/18 NC |
| 3,408,561 | 10/1968 | Redwine et al. | 340/18 LD |
| 3,732,728 | 5/1973 | Fitzpatrick | 340/18 NC |
| 3,737,845 | 6/1973 | Maroney et al. | 340/18 NC |
| 3,949,354 | 4/1976 | Claycomb | 340/18 LD |
| 4,001,774 | 1/1977 | Dawson et al. | 340/18 LD |

*Primary Examiner*—Howard A. Birmiel

*Attorney, Agent, or Firm*—Wm. T. Wofford; James M. Peppers

[57] ABSTRACT

Logging while drilling apparatus included in a rotatable drilling string of drill pipe disposed in a well bore. Apparatus generally includes a combination communication system comprising two communication channels coacting in cascade or tandem fashion with a first lower communication channel having very low attenuation characteristics but being relatively inconvenient to connect or disconnect and with a second upper communication channel having greater attenuation characteristics but being very convenient to connect or disconnect when adding drill pipe as drilling continues. Electrical power for the entire combination in the well bore is provided from a location remote from the bottom of the well. Also discloses related methods of logging while drilling.

33 Claims, 7 Drawing Figures

10
16
40
14
PUMP
12
50
28
30
18
MUD PIT
18
50
50
38
22
44
42
42
24
28
48
26
36

47
16
402'
402
40
404
406
408
410
412
414
14
404'
20
46
416
32
34
418a
418b
418c
20
18
30
38
32
28
804
802
34
44
38
806
816
22
42
810a
812
32
20
810b
814
810c
28
42
36
24
602
604
606
608
610
36
42
26

Fig. 3
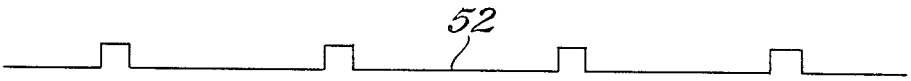
Fig. 4
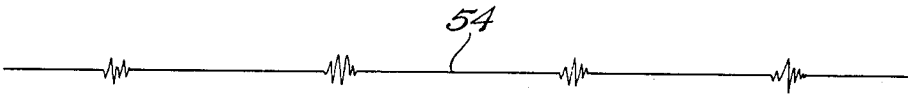
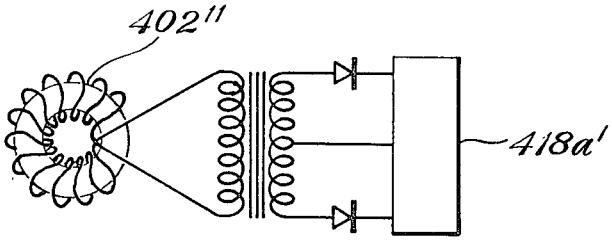
Fig. 5
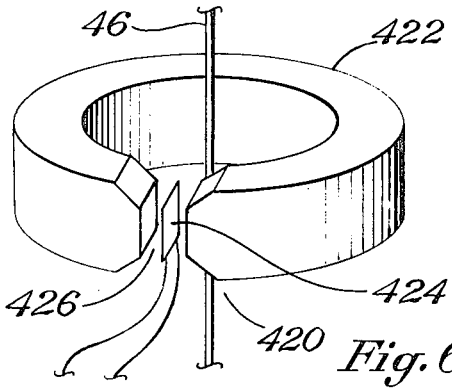
Fig. 6
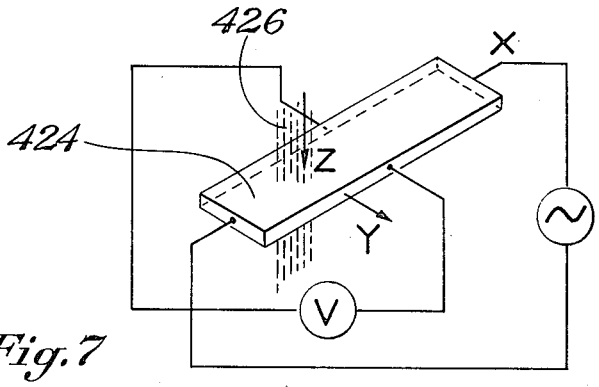
Fig. 7

WELL BORE COMMUNICATION METHOD

FIELD OF THE INVENTION

This invention generally pertains to logging while drilling apparatus and more particularly pertains to communication apparatus included with the drill pipe of a drilling string. Such apparatus transmits a signal representative of a bore hole condition sensed within a well bore to the earth's surface.

BACKGROUND OF THE INVENTION

Many proposals have been made for logging while drilling systems as shown by the following examples: Karcher, U.S. Pat. No. 2,096,279 proposes a system utilizing electrical conductors inside the drill pipe. Heilhecker, U.S. Pat. No. 3,825,078 proposes a system utilizing extendable loops of wire inside the drill pipe. Silverman, U.S. Pat. No. 2,354,887 proposes a system utilizing inductive coupling of a coil or coils with the drill pipe near the drill bit with measurement of the induced electrical potential at the earth's surface. Arps, U.S. Pat. No. 2,787,759 and Claycomb, U.S. Pat. No. 3,488,629 propose systems in which pulsed restrictions to the drilling mud flow produces pressure pulse signals at the earth's surface. Also, Godbey, U.S. Pat. No. 3,309,656 proposes a turbine like system which produces repetitive pressure waves which are representative of a measured piece of information. The foregoing prior art patents are incorporated herein by references.

Each of such proposals which has been put in field use has had some drawback of sufficient consequence to prevent its commercial acceptance. One drawback is the inconvenience and time involved for the large number of connections and disconnections of electrical connectors in systems such as proposed by Karcher. Though an induced potential measurement system such as proposed by Silverman may be considered operable for a very short distance, the signal to noise ratio of such a system would prohibit its use as a practical matter. A most significant drawback in such prior art systems is the requirement to provide an electrical power source with a sensing and signal transmitting unit located near the drill bit. Excessive signal attenuation is also a significant drawback in some such systems.

The environment is very hostile at the bottom of a well during drilling. Drill bit and drill collar vibrations may be in the order of 50 g. The temperature is frequently as much as 400° and higher. The bottom hole pressure can be more than 10,000 psi. The drilling fluid flowing through the drill collars and drill bit may be highly abrasive. With present drilling equipment including improved drill bits, the continued drilling time with a particular bit can be in the order of 100 – 300 hours and sometimes longer before it becomes necessary to change the drill bit. Accordingly, a downhole formation condition sensing and signal transmitting unit mounted near the drill bit must be capable of operating unattended for long periods of time without adjustment and with a continuing source of electrical power. Also, the signal communication apparatus must be capable of transmitting a continuing usable signal or signals to the earth's surface while additional joints of drill pipe are conventionally added as usual to the drilling string as the drilled bore hole is increased in depth.

A major problem is the provision of an electrical power source for the downhole sensing and transmitting unit at the bottom of the well with communications apparatus which does not employ an electrical conductor or cable extending from the earth's surface to the downhole unit as proposed in the previously referenced prior art. The reason for this problem is the high temperatures encountered near the drill bit and, to some extent, the severe vibration encountered. Present state of the art electrical batteries and fuel cells are not suitable for producing the necessary voltage and power requirements at the high temperatures encountered and for the extended operating time of a downhole sensing and signal unit. Turbine electrical generators driven by the drilling mud have been tried with some success but the turbine blades and bearings are quickly damaged by the abrasive mud. Also, the high temperatures and high pressures can cause the seals between the turbine and the electrical apparatus chamber to fail, sometimes after only a few hours of operation.

SUMMARY OF THE INVENTION

The present invention serves to avoid the problems involved in providing an electrical power source along with the downhole sensing unit in the hostile environment near the drill bit.

The present invention also provides a good usable signal or signals from the downhole unit to the earth's surface without requiring an electrical conductor or cable to be connected and disconnected each time that a joint of drill pipe is added to the drilling string.

The foregoing and other provisions and advantages are attained in logging while drilling apparatus included in a rotatable drilling string of drill pipe disposed in a well bore. The well bore is filled with drilling mud and is equipped with electrically grounded surface casing extending down from the earth's surface some distance into the well bore. The apparatus includes an externally powered electrical down hole condition sensing means mounted with the drill pipe near the drill bit at the lower end of the drill string and adapted to produce a first signal which is a function of a sensed down hole condition such as temperature, electrical resistivity, electrical conductivity, self potential, radioactivity, borehole inclination and bearing as examples. An electrical power supply means is mounted with the drill pipe at a selected distance above and remote from the sensing means. An electrical conductor cable means is disposed within the drill pipe with releasable electrical connection between the sensing means and the power supply means. A signal transmission means powered by the power supply means is adapted to receive the first signal through the cable means from the sensing means and to convey a corresponding second signal by means of the drill pipe to the earth's surface. A receiver means located at the earth's surface is adapted to receive the second signal and to produce an indication of the formation condition sensed by the sensing means. The first signal may be any type of electric signal capable of transmission by the cable means and the second signal may be any type of signal capable of being produced through the intervening distance. The transmission means may include an induction coil means connected in inductive coupling with the drill pipe. The receiver means may include an induction coil means connected in inductive coupling directly with the drill pipe or in inductive coupling with an electrical conductor connecting the drill pipe with the grounded surface pipe or casing. Alternately, the receiver means may be connected and adapted to directly receive and indicate the A.C. voltage between the drill pipe and the grounded surface casing. In the preferred embodiment the drill pipe is provided with a substantially insulating exterior coating of paint of several mils thickness from the transmission means up to the earth's surface to reduce attenuation of the second signal and to improve the signal to noise ratio.

The invention also involves the method of logging while drilling a well bore filled with drilling mud and equipped with grounded surface casing extending down from the earth's surface some distance into the well bore. The steps include mounting an externally powered electrical down hole condition sensing means with the lower end of a drilling string of drill pipe near the drill bit and adding successive joints of drill pipe while lowering the drilling string into the well bore. When the drilling string reaches near the bottom of the well bore an electrical conductor cable means is lowered within the drill pipe and releasably connected to the sensing means. An electrical power source and a signal transmission means including an induction coil is connected into the drill pipe at the upper end of the conductor cable means with releasable connection to the cable means and with the induction coil inductively coupled with the drill pipe. Additional joints or stands of drill pipe are connected above the power source and transmission means as the drilling string and bit is further lowered into drilling position. Such additional joints or stands of drill pipe may be substantially coated with an insulating layer of paint. A receiver and indicator means is connected with the upper end of the drilling string and drilling of the well bore is continued. During drilling the sensing means powered through the cable means by the power source produces a first signal which is transmitted through the cable means to the signal transmission means which, in turn, produces a second signal which is transmitted up through such additional joints to the receiver and indicator means. As the well is drilled deeper, additional joints of such drill pipe are connected into the drill string in conventional fashion and the logging while drilling is continued. At such time as the drilling string is removed to change bits or the like the above assembly procedure is reversed. When the drilling string is returned into the well bore the conductor cable means is lengthened in amount about the same as the depth drilled in the previous cycle and the above procedure is repeated.

A general concept of the present invention is to employ the combination of two communication channels coacting in cascade or tandem fashion. A lower first communication channel has very low attenuation characteristics but is relatively inconvenient to connect or disconnect. An upper second communication channel has relatively greater attenuation characteristics but is very convenient to connect or disconnect. The first and second communication channels are connected through an intermediate signal transmission station mounted with the drilling string at a location above and remote from an earth formation condition sensing unit mounted near the drill bit. The electrical power supply for the combination is provided at a location remote from the detrimental drilling environment and convenient as necessary for replacement or recharging when the drilling string is partially or completely removed from the well bore.

BRIEF DESCRIPTION OF THE DRAWING

FIG. 3 generally illustrates the wave form of a first signal produced in a first communication channel of the apparatus.

FIG. 4 generally illustrates the wave form of a second signal produced in a subsequent communication channel of the apparatus.

FIG. 5 is a schematic general illustration of an alternate power supply for the power supply shown in FIG. 2.

FIG. 6 is a schematic general illustration of magnetometer or current detector or probe utilizing the Hall effect and suitable as an alternate for the toroidal pick-up coil shown in FIG. 2.

FIG. 7 is a schematic general illustration of the Hall effect in a body of semiconductor material.

DESCRIPTION OF A PREFERRED EMBODIMENT

Figure 1:
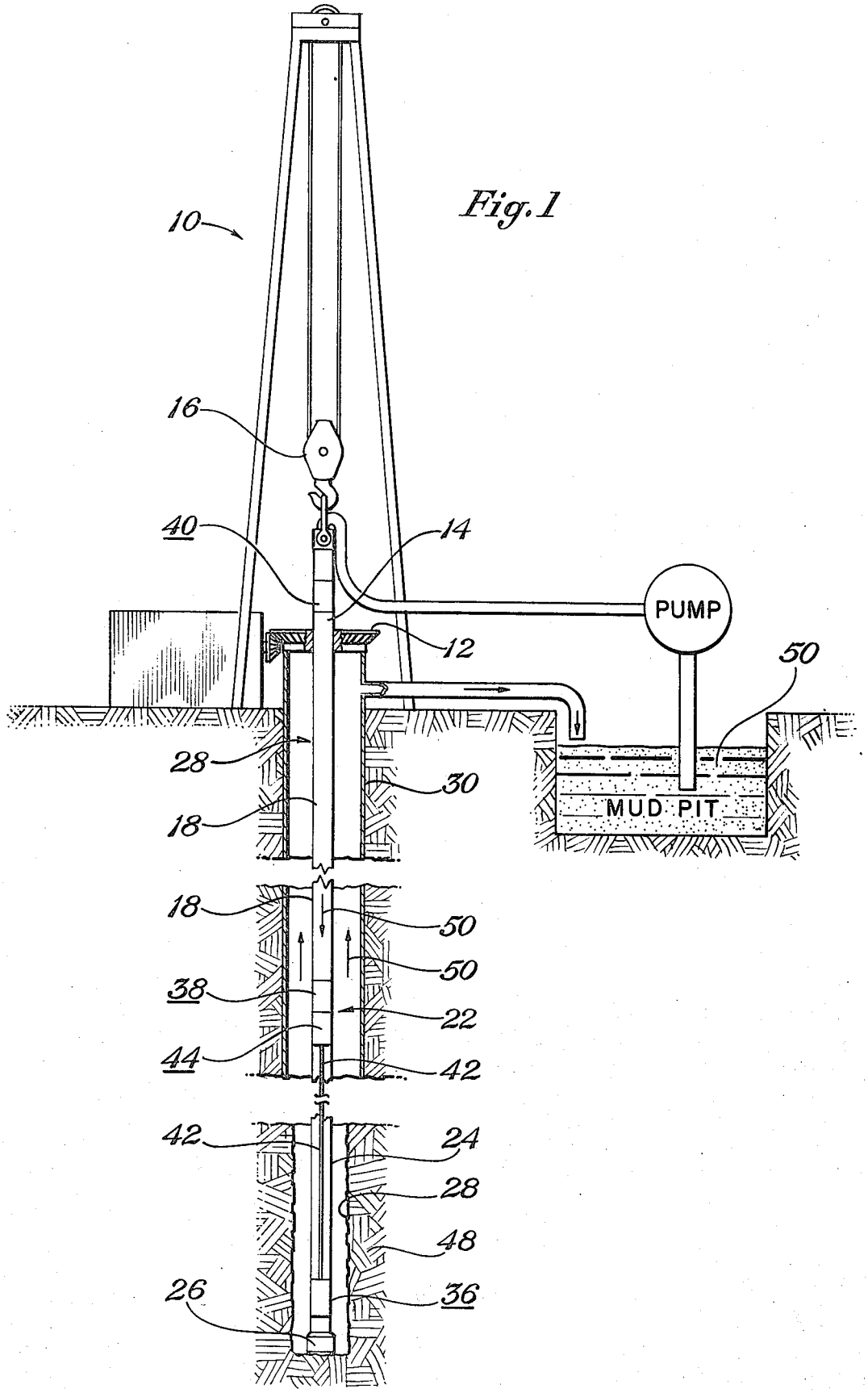
FIG. 1 is a schematic general illustration of drilling equipment including apparatus of the present invention.
Figure 2:
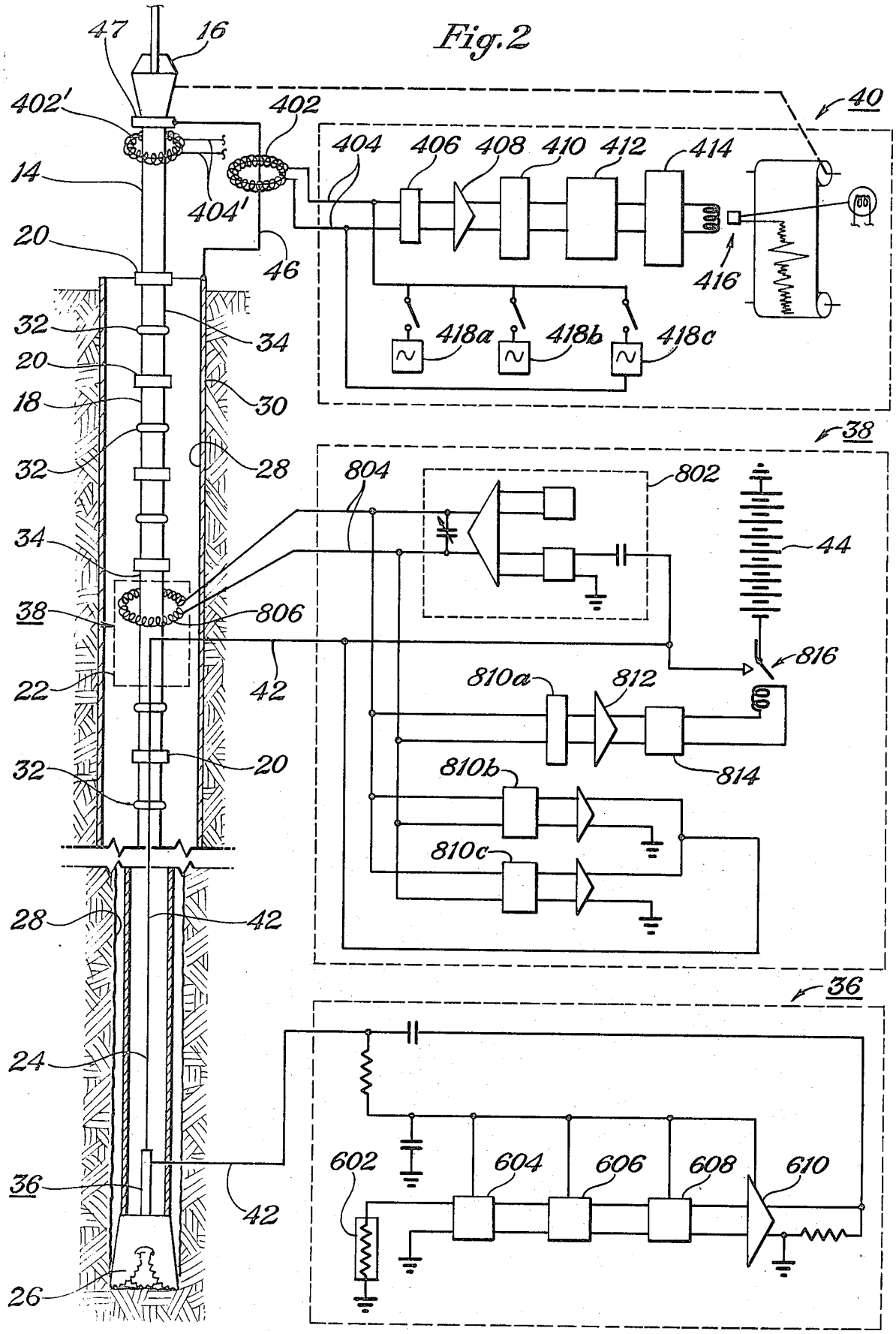
FIG. 2 is similar to FIG. 1 and is also a schematic illustration of a preferred embodiment of apparatus utilized in the present invention.

Referring to FIGS. 1 and 2, like elements bear like numbers. A conventional well drilling rig 10 is shown including a rotary table 12, a kelly 14 and a swivel 16 is supported from a crown block through a traveling block. The kelly 10 is connected to a drill string including drill pipe 18, tool joints 20, a pipe joint 22, drill collars 24 and a bit 26 extending into a well bore 28. Surface pipe 30 is installed in well bore 28 from the surface of the earth to a predetermined depth, generally several hundred feet. Mounted along drill pipe 18 between tool joints 20 are a number of conventional rubber drill pipe protectors 32.

The pipe 18 extending from the kelly 14 to the pipe joint 22 is substantially insulated electrically from the surrounding drilling fluid and the surface casing 30 by a coating 34 which may be a paint such as urethane or epoxy applied with a few mils thickness. In operation, some of the insulating coating may be worn away at the tool joints 20 and broken by pipe tongs during make-up and break-out of the pipe without significant detriment to the performance of the present invention.

As shown, the units comprising the present invention include an externally powered sensing unit 36 mounted within the drill collars 24 at the bottom of the drill string. A power supply 44, a receiver and an energizing or transmission unit 38 are mounted within pipe joint 22 intermediate the drilling string and a receiver and indicator unit 40 at the surface. An electrical conductor cable 42 is removably connected between sensing unit 36 and power unit 38 to provide a low impedance electrical connection between the units.

The particular sensing unit 36 as disclosed is provided with a "thermistor" 602 which exhibits a particular electrical resistance as a function of its temperature which is established by the temperature to be measured. Thermistor 602 is connected into a voltage controlled oscillator 604, a scaler 606, a multivibrator 608 and an amplifier 610 in a conventional manner. The output from sensing unit 36 onto the conductor 42 has a wave form 52 as shown by FIG. 3 where the time interval between pulses is a function of the temperature within the well bore and of thermistor 602.

The conductor cable 42 is releasably connected (not shown) into pipe sub 22. The sub 22 generally is located a considerable selected distance above sensing unit 36 and from a few feet below the earth's surface to about 1,000 feet, depending on how much depth is attained by a particular bit before it needs to be changed. The sub 22 may be located 10,000 feet above sensing unit 36, for example. The sub 22 houses a large long life power source 44 such as a primary battery fuel cell or storage battery. The battery 44 is connected to cable 42 and supplies power in a conventional manner for all the circuits provided in sensing unit 36 and the receiver and transmission unit 38.

The conductor 42 is connected into a "keyed oscillator" circuit 802. Such oscillators are well known in the art and will not be described in detail herein. The oscillator receives the signal such as shown in FIG. 3 and in response produces a burst of sinusoidal voltage (of frequency of about 2KHz, for example, such as shown in FIG. 4). The sinusoidal burst of voltage is applied through conductors 804 into a toroidal wound energizer or transmission coil 806. Coil 806 may be mounted in sub 22, in a manner such as disclosed in previously referenced Silverman U.S. Pat. No. 2,354,887, for example. As mounted, coil 806 produces an e. m. f. within the drill pipe 18. The e. m. f. may be in the order of several volts and is of the frequency and sequential time separation as the voltage wave form shown in FIG. 4.

This e. m. f. as generated by coil 806 generates a corresponding electrical current through the drill pipe which may be traced as follows:

a. The drill pipe 18 above energizing unit 38;
b. The kelly 14;
c. Various conductive connections (not shown) through rig 10;
d. A heavy electrical shunting conductor 46 connected from a slip ring 47 mounted on kelly 14 to casing 30;
e. The casing 30;
f. Earth formation 48 and drilling mud 50 to drill pipe 18 below Coil 806.

The electrical resistance of the above described circuit is very low (in the order of a few milliohms). Accordingly, the current through shunting conductor 46 is substantial and may be in the order of tens or hundreds of amperes.

A toroidal pickup coil 402 is mounted around shunting conductor 46 in a manner causing the current through conductor 46 to induce a voltage across the terminals of coil 402 which is substantially a replica of the voltage shown in FIG. 4, i.e., burst of voltage at about 2KHz with time separation representative of the condition measured such as temperature in the embodiment shown. Alternately a pickup coil 402' may be mounted as shown around kelly 14 to induce such a voltage. A less satisfactory but operable manner of detecting the signal voltage is to replace the conductor 46 with a potentiometic circuit (not shown) and detect the potential between kelly 14 and casing 30 directly.

The voltage bursts are transmitted over conductors 404 through a filter 406, amplifier 408, into a one shot univibrator 410. The output of univibrator 410 is connected into a frequency meter 412 having its output connected into a galvanometer 414 of a graphic recorder 416. The recording paper or film of recorder 416, through conventional interconnection with the traveling block (not shown) above swivel 16, is moved in proportion to the depths from which the temperature or other condition signals are received.

Referring to FIGS. 6 and 7, there is generally shown an A.C. magnetometer or current detector or probe 420 which may be utilized as an alternate to toroidal pickup coil 402 to measure the alternating current flowing through shunting conductor 46 (or kelly 14). Included in the detector 420 are a C-shaped laminated flux concentrator 422 provided of a permalloy like nickel-iron material which is adapted to be disposed around conductor 46 and to generate a magnetic flux at the gap of the C-shape which corresponds to the current flowing through conductor 46. A semiconductor 422 is positioned in the C-shaped gap which produces a voltage corresponding to the intensity of such magnetic flux in accordance with the Hall effect.

FIG. 7 is a diagrammatic illustration of the Hall effect in the body 422 of semiconductor material. Certain intermetallic semiconductor compounds e.g. indium arsenide and indium antimonide, possess properties necessary to make practical application of the Hall effect possible. These are representative of the class of materials used in the Hall semiconductor element of the present invention. A transverse voltage is developed across the semiconductor in the Y direction, when it carries current in the X direction, and is positioned in a magnetic field 426 in the Z direction. The semiconductor may be positioned so that the magnetic field in the C-shaped gap provides the field and then electron flow in the X direction causes flow in the Y direction as the result of the magnetic field thereby to measure the strength of the field.

Also, an A. C. current detector or probe readily adaptable as probe 420 may be a Model HP456A A. C. probe which is available from Hewlett-Packard, 3003 Scott Blvd., Santa Clara, California 95050, U.S.A..

An important feature of this system as disclosed is the provision of two-way communication between the surface equipment and the sub-surface equipment. Earlier efforts have been made to actuate the sub-surface equipment, such as with centrifigal switches, e.g., turn the equipment on while the pipe is rotating and vice versa. Such efforts were not sufficient because of the desirability of actuating the equipment independently of pipe rotation.

As shown in receiver unit 40, there is provided a plurality of command oscillators **418*a*, 418*b*, etc. which are provided to send A. C. "command" signals of respective frequency through the coupled coils 402 and 806 to the sensing unit 36 and the power unit 38**.

One purpose of such command signals is to turn the equipment in units 36 and 38 on and off. In operation, the oscillator **418*a* is actuated to send a command signal of respective frequency through coupled coils 402 and 806, filter 810*z*, and amplifier 812 to actuate a flip-flop circuit 814. The flip-flop circuit energizes a solenoid switch 816 which connects the battery 44 to conductor 42 and vice versa. This on-off command signal may be at 300 Hz, for example. In the absence of switch 816 and associated circuitry, battery 44 is connected directly to conductor 421** (not shown).

An extension of the utilization of such command signals is to provide an additional plurality of oscillators **418*b*, 418*c*, etc. with each oscillator producing a signal of respective frequency. Filters 810, 810*c*, etc., admit a respective signal and place the signal on conductor 42. Such signals are utilized, in sensing unit 36 (not shown) to switch sensing unit 36** from one type of sensor to another such as from temperature measurement to earth formation resistivity of radioactivity measurement, for example.

A further extension of the utilization of such respective frequencies is to eliminate the need for the battery 44 in power unit 38 or to recharge such a battery. For example, an oscillator 418*a*′ can be provided of sufficient capacity to pass considerable power through coupled coils 402″ and 806 to be utilized in lieu of or to recharge the battery. A conventional schematic circuit for such a power circuit is generally shown in FIG. 5.

The present invention can be considered as a dual method of telemetering in which a first communication channel is used to communicate between the bottom of the well and an intermediate location or station (located part way up the well bore) and a second communication channel is used to communicate between such intermediate location and the surface of the ground. In the embodiment of the invention as shown, such first communication channel includes electric conductor 42 and the intermediate location of pipe sub 22 would be sufficiently near the surface to avoid hostile high temperatures, pressures and vibrations. In such an arrangement, the power source 44 may be a simple assembly of rechargeable batteries such as are now commonly used in so called "cordless" hand tools, e.g. saws and drills. Nickel cadmium batteries or mercury type batteries can provide approximately 1 kilowatt hour of power in a housing that would be quite small compared to average drill pipe and drill collar dimensions. A practical sensing unit 36 for downhole measurements can be constructed that consumes about 2 watts of electric power, for example. A second communcation channel for transmission between the intermediate location and the surface as described herein above may require about 1 watt for example, if the position of the intermediate location is not too far below the surface.

When the drilling has progressed to the point where logging while drilling is to begin, electric cable 42 and its connector (not shown) is lowered into the bore hole inside the drill pipe. For example, assume that the depth at which "logging" is to commence is 10,000 feet. A 10,000 length of insulated electrical cable 42 is lowered into the bore hole and electrically connected with sensing unit 36. The second communication channel transmitter and electric power source 38 is installed and connected with wire 42. The distances covered by the second communication channel 38 to the earth's surface, is small; only a few feet to a few hundred feet. As drilling progresses, transmitter 38 gradually progresses downward and, at about every 30 feet, (the length of standard oil well drill pipe joints), additional pipe joints are added. Transmitter 38 thus progresses to greater and greater depth from the surface.

A requirement for the present invention is that the second communication channel such as units 38 and 40 be capable of transmitting over a distance of at least equal to the distance that is usually drilled by a single bit in the formation of interest. Modern drill bits can drill several hundred feet before wearing enough to require their replacement (and requiring that all the drill pipe be brought out of the bore hole).

The term "wireless communication channel" is meant to be a system using radio waves, electromagnetic inductive coupling, accoustic signals or any other system in which communication is established between two locations without the use of direct electric connection. The transmission properties of a wireless bore hole communication system is characterized by what is termed logarithmic attenuation. Using telephone terminology, if the attenuation for 1,000 feet is 30 db, then the attenuation for 10,000 feet is 300 DB. An attenuation of 30 db is equal to a power ratio of 1000. Thus, if we assume that at the surface a signal of milliwatt is required to constitute a practically usable signal at the surface, then the transmitter 38 (at 1000 feet) will require a power of 1 watt. If the same communication channel were used to transmit the entire distance of 10,000 feet, then the transmitter would require more electric power than is feasiable. It can be seen, therefore, that any communication system that possesses even moderate attenuation is not capable to transmit information a great distance from the bottom of a well bore to the surface. At moderate frequencies, an insulated wire electric cable, however, has an attenuation only a few db per mile and is well capable of transmitting signals 10,000 or 20,000 feet.

Thus, in the present invention, a combination of two telemetric systems is provided with the first system being rather inconvenient but having very low attenuation and the second being very convenient but having higher attenuation characteristics. As an example, 30 feet pipe joints are added to drill pipe 18 as drilling progresses, sometimes several per day, using the second communication channel in the upper section of the string of drill pipe. Addition of the pipe presents absolutely no inconvenience to or added work for the drilling crew; the drilling pipe is added simply in the conventional manner. When the drill bit is worn out and requires replacement (say after 800 feet of drilling), the pipe is removed from the bore hole. The following procedure is followed as an example:

1. 800 feet of drill pipe 18 is removed and stacked;
2. The 10,000 feet length of cable 42 is removed;
3. The 10,000 feet of pipe 18 is removed and stacked;
4. The bit 26 is changed;

10,000 feet of drill pipe 18 is installed;

6. A cable 42 of 10,800 feet length (either entirely new cable or 800 feet of new cable connected to the previous 10,000 feet) is installed;
7. The second telecommunication channel transmitter 38 is installed (800 feet higher than the first time); and
8. Drilling is resumed as before.

It should be noted that step 6 of the above sequence may seem complex but it must be pointed out that between step 2 and step 6 several hours will have elapsed since a round trip is a lengthy time consuming process and that, during these several hours, there is plenty of time to install, replace or splice the new 10,800 length of cable.

An important feature of the present invention is the provision of a relatively more efficient second communication channel. In the past many attempts have been made to use the steel drill pipe 18 as a conductor. These attempts have uniformly failed because of a lack of understanding of the conditions involved. Drill pipe is made of steel and has a specific resistance of about $2.10^{-5}$ ohm/cm. Oil well mud is an aqueous solution and has a specific resistance of about $10^2$ ohm/cm. This favorable resistivity ratio of approximately $10^7$ has lead previous workers to believe that transmission can be accomplished by using the drill pipe as a conductor and the mud as a dielectric. Attempts have been made before to use inductive coupling for transmission of the signals along through the drill pipe without commercial success (probably because of insufficient understanding of the operation of the apparatus). However, while drill pipe has very low resistance, it also has low but not negligible inductance. All the impedances in an inductive coupled system including drill pipe are very low, i. e., expressed in milliohms. Ordinary earth formations have resistances in the order of a few ohm meters. The resistance to ground of the bit 26 and lower drill pipe 18 can be of the order of 1 milliohm in the inductive coupled system herein described and a superficial calculation indicates that relatively good transmission can be accomplished. What is frequently overlooked is that, for a precise calculation of the iterative impedance, it is necessary to take into account the inductance of the drill pipe 18.

The formula for inductance of a coaxial conductor is:

$$L = 2\log_n \frac{b}{c} + \frac{1}{2} + \frac{c^2}{3b^2} - \frac{c^4}{12b^4} + \frac{c^6}{30b} \text{ ---- } \times 10^{-9} \text{ henrys}$$

where $b$ = inner radius of the casing; and $c$ = outer radius of the drill pipe.

It may be assumed that the first term $\mathbf{2}\log_n b/c \simeq \mathbf{3}$ for a practical case, and consequently the inductance can be calculated as about 200 microhenry's per 1000 feet (distributed). This is by no means negligible and, at several kilohertz, represents the major part of the drill pipe impedance. Now, in the embodiment of the invention in which electric conduction by the drill pipe is used for the second communication channel, the drill pipe 18 was painted with a few mils of good wear resistant and insulating paint such as Urethane or Epoxy. The first 10 or 20 joints (300' to 600') of pipe were provided with rubber drill pipe protectors (which are commonly used). By the use of these conventional rubber protectors, the drill pipe is prevented from rubbing against the casing and the paint is less likely to wear off. When paint is used, the electric leakage from the drill pipe 18 to the casing 30 is, of course, substantially reduced. If the paint were continuous the leakage would be reduced to zero but in a practical case where, for example, 95% of the area of the drill pipe is covered with paint and 5% is rubbed off or knocked off, the insulation is increased from approximately 1 milliohn for bare pipe to 20 milliohms for the painted pipe. Furthermore, and what has been previously overlooked, the configuration of the coaxial conductor is drastically changed. The outer conductor in the above formula is now the mud (and not the casing) and the ratio ($b/c$) becomes very nearly 1 and the first term in the equation i.e. $\mathbf{2}\log_e(b/c)$ becomes very nearly equal to zero. This has a drastic effect on the inductance of the drill pipe and consequently a drastic effect on the high frequency transmission over the drill pipe. Whereas previous attempts to achieve communication by use of the drill pipe as a conductor required the use of very low frequencies (of the order of 1 hertz), good transmission is accomplished with the painted pipe with frequencies of 2KHz to as high as 20KHz.

From the foregoing it may be seen that the present invention provides:

a. An efficient and practical method and apparatus for transmitting measurement signals during the drilling of a well from the well bottom to the earth's surface.

b. A practical method and apparatus for providing two-way communication between the surface and the sub-surface.

c. A practical method and apparatus for providing the sub-surface equipment to be switched on and off.

d. A practical and convenient method and apparatus for providing electrical power from the surface to the units in sub-surface locations.

Some of the features set forth for the above described system can be attained through accoustic coupling of the drilling mud 50 through pipe 18 from an alternate transmission unit 38 to an alternate receiver unit 40. Referring to FIG. 1, a downhole mud pressure pulse signalling device may be provided and utilized as transmission unit 38 and a mud pulse decoding and recording or indicating device may be provided and utilized as receiver unit 40. Such devices and their operation are known and disclosed, for example, in previously referenced Claycomb, U.S. Pat. No. 3,488,629.

In the description of particular embodiments of the invention data transmission codes have been illustrated as examples, e.g., pulse-time modulation and coded sine wave signals of various frequencies. The above codes are shown as simple examples only. In actuality, for each telemetering and telecommunication operation, certain codes are more efficient than others. Modern telecommunication employs mostly digital-binary codes and phase modulation using closed phase-lock loops and such systems are to be preferred in many applications of this invention.

In order to transmit data over a communication channel that contains a substantial amount of noise (e.g. 60 Hz pick-up from power lines, various emf's generated by the drill string motions in the earth's magnetic field, etc.) encoding the data in the digital form has proved to have very good noise immunity. A digitally expressed number or "word" can be received and decoded in such a manner that, if the "word" lacks a "bit" or "bits" or contains spurious signals, it is rejected by the decoder and not used as "read" and only words that are completed are employed in the decoding process. Noise is rejected and, by redundancy, a signal can be transmitted through a channel with intense interfering noise.

It must be understood, that in this specification, the illustrative code forms were chosen for reasons of simplicity of explanation and that other and frequently more suitable and efficient coding systems can be used.

In addition to the embodiments disclosed and described herein, it is to be understood that the spirit of the invention includes equivalent embodiments limited only by the purview of the claims included herewith.

What is claimed is:

1. Logging while drilling apparatus including a rotatable drilling string of drill pipe disposed in a well bore, the combination comprising:

a. an externally powered electrical downhole condition sensing means mounted near the drill bit of said drilling string and adapted to produce a first signal which is a function of a sensed downhole condition;

b. an electrical power supply means mounted at a selected distance of at least several hundred feet above and remote from said sensing means and approximately equal to the well bore depth at which the logging operation would normally begin;

c. an electrical conductor cable means disposed within said drill pipe with releasable electrical connection between said sensing means and said power supply means;

d. signal receiving and signal transmission means mounted with said drill pipe in close connection with said power supply means and said cable means and adapted to receive said first signal through said cable means from said sensing means and to produce a corresponding second signal which is transmitted by means of said drill pipe on up through said well bore to the earth's surface; and e. receiver means in connection with said drill pipe at the earth's surface adapted to receive said second signal and to produce an indication of said sensed downhole condition.

2. The apparatus of claim 1 wherein said transmission means includes electrical induction coil means connected in inductive coupling with said drill pipe and adapted to induce an alternating current in said drill pipe as said second signal.

3. The apparatus of claim 2 wherein said receiver means includes induction means connected in inductive coupling to produce an A.C. voltage corresponding to said current induced in said drill pipe.

4. The apparatus of claim 3 wherein said receiver means is adapted to produce an A.C. voltage responsive to said current induced in said drill pipe.

5. The apparatus of claim 3 wherein said drill pipe is predominantly covered exteriorly with a thin insulating coating only from said transmission means up to the earth's surface.

6. The apparatus of claim 1 wherein said first signal is an electrical potential.

7. The apparatus of claim 1 wherein said receiver means includes induction means connected in inductive coupling with a shunt conductor connected between near the upper end of said drill pipe and ground potential at the earth's surface to produce an A.C. voltage corresponding to said current induced in said drill pipe.

8. The apparatus of claim 1 wherein said receiver means is adapted to produce an A.C. voltage responsive to said current induced in said drill pipe.

9. The apparatus of claim 1 wherein said drill pipe is predominantly covered exteriorly with a thin insulating coating only from said transmission means up to the earth's surface.

10. The apparatus of claim 1 wherein said receiver means includes command means adapted to send at least one respective command signal by means of said drill pipe to said transmission means and said transmission means includes command signal receiving means adapted to receive said command signal and to cause an electrical switching function to be performed in response thereto.

11. The apparatus of claim 10 wherein said command signal receiving means is adapted to connect and disconnect said power means with said sensing means and said transmission means.

12. The apparatus of claim 10 wherein said command signal means is adapted to switch said sensing means from sensing one downhole condition to another downhole condition.

13. The apparatus of claim 1 wherein said power supply means includes A.C. voltage generating means at the earth's surface adapted to impress an A.C. power voltage of a respective frequency across an induction transmission coil means connected in inductive coupling with said drill pipe and an A.C. voltage receiving means including an induction receiving coil means connected in inductive coupling with said drill pipe near said signal transmission means and adapted to produce an A.C. power voltage responsive to current induced in said drill pipe by said induction transmission coil means.

14. A method of logging while drilling a well bore through a drilling string comprising the steps of:

a. lowering an externally powered downhole condition sensing means mounted near the bit of the drilling string to a position near the bottom of the well bore;

b. lowering an electrical conductor cable means into releasable connection with the sensing means;

c. mounting an intermediate station including a signal transmission means in the drilling string at a location above and remote from the sensing means and in releasable connection with the cable means to establish a lower first communication channel from the sensing means through the cable means to the transmission means;

d. adding additional drill pipe to the drilling string above the intermediate station until the bit reaches the bottom of the well bore;

e. mounting a receiver means with the drilling string at the earth's surface to establish an upper second communication channel from the transmission means through the drill pipe to the receiver means;

f. providing electrical power to the sensing means and the transmission means from said intermediate station;

g. resuming drilling of the well bore with the drilling string;

h. producing a first signal through the first communication channel with first signal being representative of a downhole condition sensed by the sensing means;

i. producing a second signal through the second communication channel which second signal is a function of the first signal;

j. producing an indication at the receiver means which indication is representative of the downhole condition sensed by the sensing means; and k. conventionally including additional joints of drill pipe in the drilling string and in the second communication channel as drilling of the well bore is continued.

15. The method of claim 14 wherein the second signal produced is an electrical alternating current.

16. The method of claim 15 wherein the first signal produced is an electrical potential.

17. The method of claim 15 wherein the drill pipe included in the second communication channel is substantially covered exteriorly with a thin insulating coating.

18. The method of claim 14 wherein the first signal produced is an electrical potential.

19. The method of claim 14 wherein the drill pipe included in the second communication channel is substantially covered exteriorly with a thin insulating coating.

20. The method of claim 14 wherein the second signal produced is a succession of pressure pulses impressed on the drilling mud flowing through the second communication channel as drilling of the well bore continues.

21. A system for transmitting data from a sensor at the bottom of a drill string to an indicator at the surface of the earth, comprising:

a. a wireless signal transmitter positioned at an intermediate location between said bottom and said surface;

b. an electrical wire directly interconnecting said sensor and said signal transmitter with said sensor and said transmitter being disposed several hundred feet apart;

c. an electrical power source interconnected with said electrical wire and adapted to energize said sensor and said transmitter; and d. a wireless communication channel including said transmitter and said indicator.

22. The system of claim 21 wherein said wireless communication channel is adapted to utilize inductive coupling.

23. A logging while drilling method used with a rotatable drilling string of drill pipe disposed in a well bore, the steps of:

a. producing a first signal which is a function of a sensed downhole condition with an externally powered electrical condition sensing means mounted near the drill bit of said drilling string and connected through an electrical conductor cable means disposed within said drill pipe with releaseable electrical connection between said sensing means and an electrical power supply remotely mounted in said drill pipe at a substantial selected distance of at least several hundred feet above said sensing means;

b. receiving said first signal through said cable means from said sensing means and producing a corresponding second signal which is transmitted by means of said drill pipe on up through said well bore to the earth's surface from a signal receiving and transmitting means mounted with said drill pipe in connection with said power supply means and said cable means;

c. receiving said second signal and producing an indication of said sensed downhole condition in a receiver means in inductive connection with said drill pipe at the earth's surface.

24. The method of claim 23 where said transmission means includes electrical induction coil means connected in inductive coupling with said drill pipe and inducing an alternating current in said drill pipe as said second signal.

25. The method of claim 23 wherein said first signal is an electrical potential.

26. The method of claim 23 wherein said receiver means produced an AC voltage responsive to said current induced in said drill pipe.

27. The method of claim 23 wherein said drill pipe is predominently covered exteriorly with a very thin insulating plastic coating only from said transmission means up to the earth's surface.

28. The method of claim 23 wherein said receiver means includes command means sending at least one respective command signal by means of said drill pipe to said transmission means and said transmission means includes command signal receiving means receiving said command signal, causing an electrical switching function to be performed in response thereto.

29. The method of claim 28 wherein said command signal receiving means may connect and disconnect said power means with said sensing means and said transmission means.

30. The method of claim 28 wherein said sensing means may be switched from sensing one downhole condition to sensing another downhole condition by said command signal means.

31. The method of claim 23 wherein said signal transmission means produces a drilling mud pulse signal and said receiver means receives and decodes said mud pulse signal.

32. The method of claim 23 wherein said receiver means includes induction means connected in inductive coupling with an electrical ground conductor cable connected between said drill pipe and ground potential at the surface of said well bore and producing an AC voltage corresponding to said current induced in said drill pipe.

33. The method of claim 32 wherein said receiver means produces an AC voltage responsive to said current induced in said drill pipe.

* * * * *